US005728657A

United States Patent [19]

Campbell et al.

[11] Patent Number: 5,728,657

[45] Date of Patent: Mar. 17, 1998

[54] PRODUCTION OF LOW FINE SEDIMENT HIGH TBN PHENATE STEARATE

[75] Inventors: Curt B. Campbell, Hercules, Calif.; Christopher S. Fridia, New Orleans, La.

[73] Assignee: Chevron Chemical Company, San Ramon, Calif.

[21] Appl. No.: 869,514

[22] Filed: Jun. 5, 1997

Related U.S. Application Data

[63] Continuation of Ser. No. 699,746, Aug. 20, 1996, abandoned.

[51] Int. Cl.[6] ..... C10M 159/22

[52] U.S. Cl. ..... 508/460; 508/574

[58] Field of Search ..... 508/460, 574

[56] References Cited

U.S. PATENT DOCUMENTS

| | | | |
|---|---|---|---|
| 3,372,116 | 3/1968 | Meinhardt | 252/36 |
| 5,069,804 | 12/1991 | Marsh et al. | 508/460 |
| 5,162,085 | 11/1992 | Cane et al. | 508/460 |
| 5,223,163 | 6/1993 | Coolbaugh | 508/574 |
| 5,433,871 | 7/1995 | O'Connor et al. | 508/460 |

FOREIGN PATENT DOCUMENTS

| | | | |
|---|---|---|---|
| 0 273 588 | 11/1987 | European Pat. Off. | C10M 159/22 |
| 0 410 648 | 7/1990 | European Pat. Off. | C10M 159/20 |
| 0 486 893 | 11/1991 | European Pat. Off. | C07G 17/00 |
| 0 558 021 | 2/1993 | European Pat. Off. | C07C 37/66 |
| 0 601 721 | 11/1993 | European Pat. Off. | C10M 159/22 |
| 0 640 682 | 8/1994 | European Pat. Off. | C10M 159/22 |

*Primary Examiner*—Jacqueline V. Howard
*Attorney, Agent, or Firm*—Ernest A. Schaal

[57] ABSTRACT

An overbased phenate stearate is produced by overbasing a mixture that comprises sulfurized phenate, metal stearate (such as calcium stearate), at least one solvent, calcium hydroxide, and water, by contacting the mixture with carbon dioxide in the presence of an alkyl polyhydric alcohol, such as ethylene glycol. The level of agitation is maintained at a level sufficiently high so that all solids are suspended over the length of the overbasing step. The polyhydric alcohol to water ratio is maintained sufficiently high so that the ratio is at least 4:1 at the end of the overbasing step. The overbased mixture is stripped to produce an overbased phenate stearate having less than 0.10 vol. % fine sediments.

7 Claims, 2 Drawing Sheets

Effect of Ethylene Glycol to Water Ratio at Low Agitiation (ASL of 1-2)

Effect of Ethylene Glycol to Water Ratio at Low Agitiation (ASL of 1-2)

Effect of Ethylene Glycol to Water Ratio
at High Agitiation (ASL of 3-5)

PRODUCTION OF LOW FINE SEDIMENT HIGH TBN PHENATE STEARATE

This is a continuation of application Ser. No. 08/699,746, filed Aug. 20, 1996, now abandoned.

The present invention relates to the production of highly overbased phenate stearate.

BACKGROUND OF THE INVENTION

The present invention comes out of work in the production of phenate stearate having a high Total Base Number (TBN). That production is hampered by the creation of a fine sediment. The fine sediment is virtually impossible to remove from the product by means common to the manufacture of phenate, such as filtration.

EPO 0,094,814 A2 teaches improving the stability of an overbased phenate by treating the phenate with a carboxylic acid having a $C_{10}$ to $C_{24}$ unbranched segment, such as stearic acid.

WO 88/03944 and 88/03945 teach an overbased phenate having a TBN of more than 300. This high TBN is achieved by using an additional component: either a carboxylic acid, such as stearic acid, or a di- or poly carboxylic acid having from 36 to 100 carbon atoms, or an anhydride, acid chloride, or ester thereof.

SUMMARY OF THE INVENTION

The present invention provides a process that produces an overbased sulfurized phenate stearate without producing fine sediments. That process controls the degree of agitation and the ratio of ethylene glycol to water during the overbasing process to prevent the formation of fine sediments.

In this process, a mixture having a sulfurized phenate, a metal stearate (such as calcium stearate), at least one solvent, calcium hydroxide, and water is overbased by contacting the mixture with carbon dioxide in the presence of an alkyl polyhydric alcohol. Throughout the overbasing step, the level of agitation is sufficiently high so that all solids are suspended over the length of the overbasing step. After the overbasing step, the overbased mixture is stripped to produce an overbased phenate stearate having less than 0.10 vol. % fine sediments.

Preferably, the polyhydric alcohol to water ratio is maintained sufficiently high so that the ratio is at least 4:1 at the end of the overbasing step. More preferably, the polyhydric alcohol to water ratio is maintained sufficiently high so that the ratio is at least 9:1 at the end of the overbasing step. Preferably, the overbased phenate stearate has less than 0.05 vol. % fine sediments.

The alkyl group of the alcohol has from one to five carbon atoms. Preferably, the alkyl polyhydric alcohol is ethylene glycol.

The sulfurized phenate to be overbased can comprise a partially overbased sulfurized phenate.

BRIEF DESCRIPTION OF THE DRAWINGS

In order to assist the understanding of this invention, reference will now be made to the appended drawings. The drawings are exemplary only, and should not be construed as limiting the invention.

DETAILED DESCRIPTION OF THE INVENTION

Figure 1:
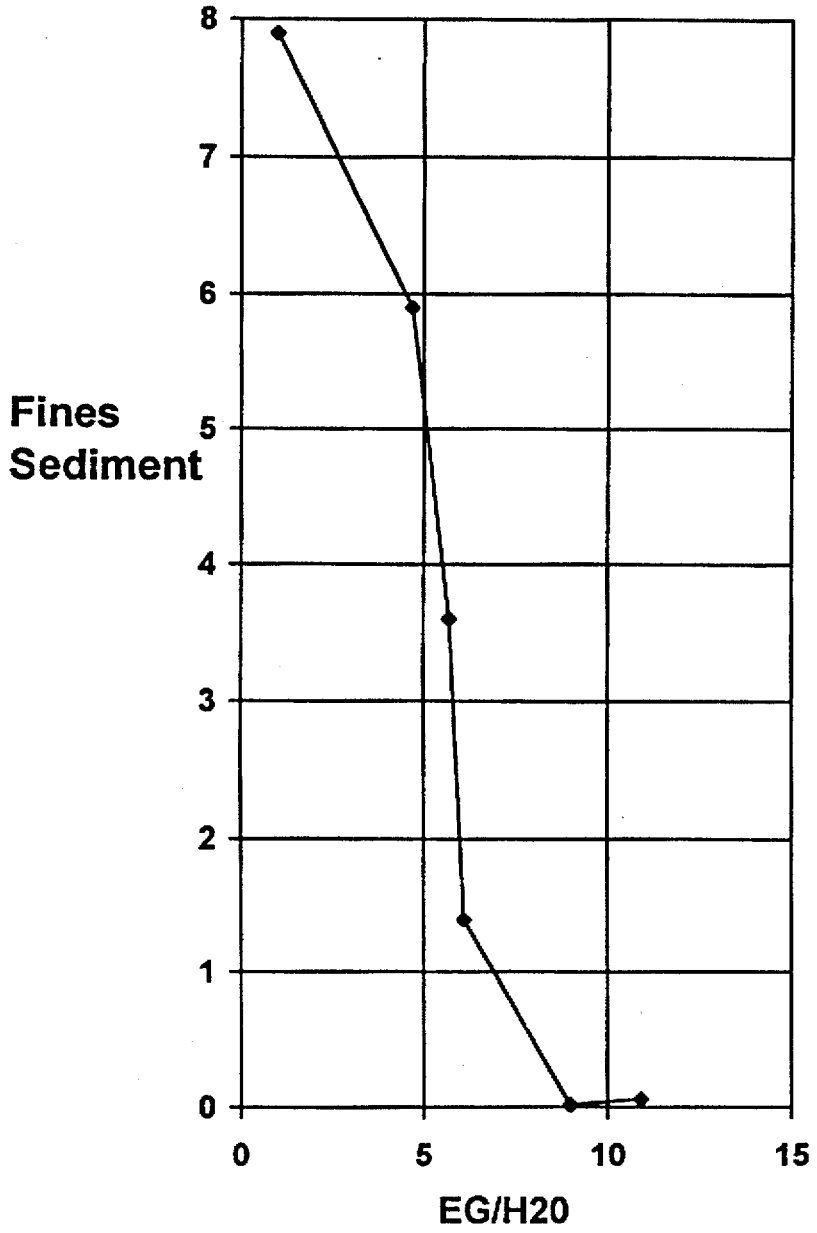
FIG. 1 shows how fine sediment varies as a function of degree of agitation and the weight ratio of ethylene glycol to water at the end of the carbonation step in the process, in a reactor operating with poor agitation.

In its broadest aspect, the present invention involves a process for producing an overbased phenate stearate without the production of fine sediments. That process comprises overbasing a mixture that comprises sulfurized phenate, metal stearate, at least one solvent, calcium hydroxide, and water, by contacting the mixture with carbon dioxide in the presence of an alkyl polyhydric alcohol, and stripping the overbased mixture to produce an overbased phenate stearate having less than 0.10 vol. % fine sediments.

In order to achieve less than 0.10 vol. % fine sediments, one must maintain the level of agitation sufficiently high so that all solids are suspended over the length of the overbasing step. Preferably, one should also maintain a polyhydric alcohol to water ratio sufficiently high so that the ratio is at least 4:1 at the end of the overbasing step.

In order to achieve less than 0.05 vol. % fine sediments, one should maintain a polyhydric alcohol to water ratio sufficiently high so that the ratio is at least 9:1 at the end of the overbasing step.

The alkyl group of the alkyl polyhydric alcohol should have from one to five carbon atoms. One such useful alkyl polyhydric alcohol is ethylene glycol. The stearate can calcium stearate, and the sulfurized phenate can comprises an sulfurized phenate that has been previously overbased.

FINE SEDIMENTS CONTENT

The fine sediment was determined by following a modification of the ASTM Test Method D 2273 ( Standard Test Method for Trace Sediment in Lubricating Oils). The modified test method consists of filling a centrifuge tube to the 75 ml mark with naptha and adding sufficient final, stripped and filtered sample to fill the tube to the 100 ml mark. A stopper is placed in the tube and it is shaken until the filtered sample completely dissolves in the naptha. The tube is then placed in a centrifuge operating at 4000 RPM's. The sample is spun for 15 minutes at 4,000 RPM and then the volume of the centrifuged solids at the bottom of the tube is read. The fine sediment in the sample is calculated as follows:

$$\text{Volume \% Fine Sediment in Sample} = 4 \times (\text{ml of sediment read in centrifuge tube}).$$

During the process to produce the high TBN overbased phenate stearate, two factors strongly affect the quality of the high TBN overbased phenate stearate. These factors are:

(1) how well the carbon dioxide gas is dispersed into the reaction medium during the overbasing step, and (2) the ratio of the weight percent of ethylene glycol to water in the reactor at the end of the overbasing step.

The degree to which the carbon dioxide gas is dispersed, or mixed, into the reaction depends on the effectiveness of the gas-liquid mixing in a particular reactor. Engineering analysis of the gas-liquid mixing occuring during overbasing revealed that one contributing factor to the formation of this fine sediment was localized overoverbasing or inadequate gas-liquid mixing. During carbonation, adequate gas-liquid mixing is necessary to prevent the formation of a fine sediment.

AGITATION LEVEL

The effectiveness of gas-liquid mixing for a specific reactor can be expressed as an Agitation Scale Level (ASL) value, a term often used in the industry. The ASL value for a given reactor is a function of reactor diameter, liquid volume, impeller diameter, number of impeller blades, impeller blade pitch, impeller blade height, liquid density, liquid viscosity, impeller RPM and gas flow rate. The ASL scale ranges between 0 and 10 and can be broken into four groups:

| ASL | Description |
|---|---|
| 0 | Indicates a flooded impeller. |
| 1–2 | Provides nonflooded impeller conditions for coarse dispersion of gas. Typical applications are ones in which mass transfer or gas dispersion is not critical. |
| 3–5 | Drives fine bubbles completely to vessel wall and recirculation of dispersed bubbles back into the impeller. Gas dispersion is considered moderate. |
| 6–10 | Provides maximum interfacial area and recirculation of dispersed bubbles back into impeller. Characteristic of gas-liquid reactions where rapid mass transfer is required. |

We have found that an agitation scale revel of 3 would be sufficient to suspend all solids over the length of the overbasing step.

POLYHYDRIC ALCOHOL TO WATER RATIO

During the overbasing steps of the reaction, polyhydric alcohol, such as ethylene glycol, is present in the reactor to aid in reactions taking place. Also during the reaction, water is produced by the neutralization reactions between the calcium hydroxide and the alkylphenol and stearic acid and also between the reaction of calcium hydroxide with carbon dioxide. In general, the bulk of this water is removed during the reaction. As the water is removed from the reactor, it removes some of the ethylene glycol from the reactor as well (even though, in theory, the reactor temperature and pressure is such that ethylene glycol should not be distilling). This removal of the ethylene glycol is also increased during the overbasing step if inefficient gas-liquid mixing is present. Also, if good vacuum control is not maintained during the reaction (specifically too high a vacuum is maintained), too much water and ethylene glycol can be removed from the reaction which can result in the formation of this fine sediment. Consequently, it has been found that their is an optimum ratio of the weight percent ethylene glycol to water that should be present in the reactor at the end of the overbasing step that prevents the formation of the fine sediment. The weight percent ethylene glycol and water present in the reactor is determined by removing a sample of the reactor contents and subjecting the sample to an azeotropic distillation using Xylene and collecting the distillate which then contains the ethylene glycol and water as a separate phase. The amount of ethylene glycol present in this separate phase is determined by refractive index.

EXAMPLES

The invention will be further illustrated by following examples, which set forth particularly advantageous method embodiments. While the Examples are provided to illustrate the present invention, they are not intended to limit it.

EXAMPLE 1

To a clean 4,000 gallon (15,151 liters) reactor equipped with a variable speed agitator, operating to provide a sufficiently high level of agitation so that all solids are suspended over the length of the overbasing step, were charged 3,654 pounds (1,657 kilograms) of diluent oil, 7,435 pounds (3,372 kilograms) of decyl alcohol, 483 pounds (219 kilograms) of ethylene glycol, 4,825 pounds (2,188 kilograms) of dodecyl phenol, 2,760 pounds (1,251 kilograms) of calcium hydroxide, and 150 pounds (68 kilograms) of calcium chloride dihydrate with the agitator turned on at approximately 75° F. (24° C.). To this mixture was then added 3,100 pounds (1,406 kilograms) of solid stearic acid. The contents of the reactor were heated to 150° F. (65° C.). When the reactor temperature reached 150° F.±10° F. (65° C.±5° C.), an additional 2,760 pounds (1,251 kilograms) of calcium hydroxide was charged to the reactor. The reactor pressure was then maintained at 4.0+0.2 psia (0.28±0.014 kg/cm$^2$) of vacuum with the sour gas system.

The reactor was heated to 290° F.±5° F. (143° C.±2° C.) over 1.5±0.25 hours. When the reactor reached 290° F.±5° F., 803 pounds (364 kilograms) of liquid sulfur was charged to the reactor and allowed to mix for 10–20 minutes to ensure complete incorporation of the sulfur into the reactor. The reactor was then heated to 300° F. (148° C.). When the reactor contents reached 300° F.±5° F. (148° C.±2° C.), 580 pounds (263 kilograms) of ethylene glycol was added over 1.5 hours while the reactor was heated to 350° F.+5° F. (176° C±2° C.). When the reactor reached 350° F.±5° F., pounds (817 kilograms) of carbon dioxide was added at a rate of 9.68 pounds/minute (4.39 kilograms/minute) simultaneoulsy while adding 1,152 pounds (522 kilograms) of ethylene glycol at a rate of 6.4 pounds/minute (2.9 kilograms/minute) over 3 hours. When the carbon dioxide and ethylene glycol additon was complete, 468 pounds (212 kilograms) of Carbon dioxide was added at a rate of 3.9 pounds/minute (1.8 kilograms/minute) over 2 hours. At the end of the overbasing step, a 1 quart (0.946 liter) sample was removed from the reactor and the water and ethylene glycol in a 100 gram aliquot of this sample was subjected to azeotropic distillation to afford 2.6 mls of azeotrope. The ethylene glycol content of this azeotrope was determined by refractive index to be 90.0 %, .or 2.3 grams of ethylene glycol. The remaining mass of the azeotrope, 0.30 grams, represented the water content of the azeotrope. The ethylene glycol to water weight ratio, therefore, was 9.0. At the end of this second carbon dioxide addition, remaining water, produced from the neutralization reactions between alkylphenol and stearic acid with calcium hydroxide and the reaction of calcium hydroxide with carbon dioxide, and remaining ethylene glycol was removed by vacuum distillation. This was accompolished by reducing the vacuum in the reactor to 5.9 psia ±1 psia (0.41±0.007 kg/cm$^2$) gradually over a period of 30 minutes while maintaining the temperature at 350° F.±5° F. (176° C.±2° C.). Following this removal of the water and ethylene glycol, the reactor distillation receiver was changed and the decyl alcohol solvent, and residual ethylene glycol, was removed from the reaction by further vacuum distillation. To accompolish this, the reactor vacuum was reduced to 0.5–1.5 psia (0.035–0.11 kg/cm$^2$) gradually over 30 minutes while heating the reactor temperature to 425° F.±5° F. (218° C.±2° C.). When the reactor reached 425° F.±5° F. and 0.5–1.5 psia, it was held for 1.5 hours.

Following this second distillation, the reactor vacuum was broken with purge nitrogen and the reactor was cooled to 350° F.±5° F. (176° C.±2° C.), and the contents of the reactor (18,603 pounds or 8,438 kilograms) was pumped to a storage tank. Following this, 718 pounds (325 kilograms) of diluent oil was flushed through the reactor and pump into the storage tank.

The product in the storage tank was then filtered through a Schenk filter with the aid of a filter aid to afford a prduct with the following average properties: TBN=387, Ca=14.3 %, S=2.15 %, CO2=10.3 %, S/Ca=0.15, CO2/Ca=0.72, Viscosity=377 cSt (100° C.) and sediment 0.02 Vol. %.

EXAMPLE 2

Referring to FIG. 1, a series of runs were made to show how fine sediment varies as a function of degree of agitation and the weight ratio of ethylene glycol to water ($EG/H_2O$) at the end of the carbonation step in the process, in a reactor operating with poor agitation (an Agitation Scale Level of between 1 and 2). FIG. 1 shows that as the $EG/H_2O$ ratio increases; the level of fine sediment decreases dramatically. For example, at an $EG/H_2O$ ratio of 4.7, a fine sediment content of 5.9 volume % is observed while at an $EG/H_2O$ ratio of 9.0, an average fine sediment of 0.026 volume % is observed (average of three different reactions showing 0.02, 0.02 and 0.04 volume % fine sediment).

Figure 2:
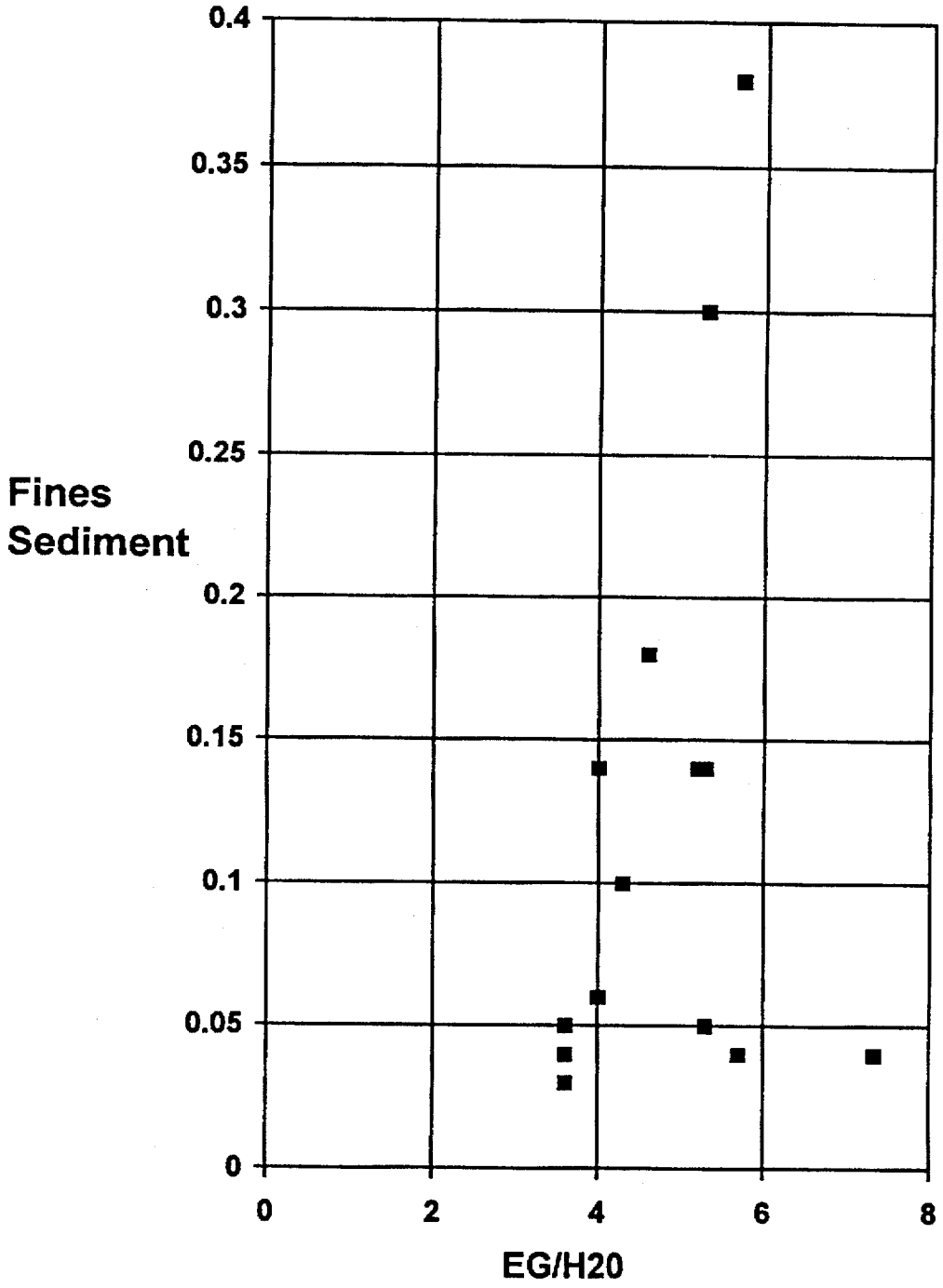
FIG. 2 shows how the fine sediment varies as a function of the weight ratio of ethylene glycol to water at the end of the carbonation step in the process, in a reactor operating with good agitation.

FIG. 2 shows how the fine sediment varies as a function of the weight ratio of ethylene glycol to water ($EG/H_2O$) at the end of the carbonation step in the process, in a reactor operating with good agitation (an Agitation Scale Level of between 3 and 4). FIG. 2 shows that as the $EG/H_2O$ ratio increases; the level of fine sediment decreases but not as dramatically as when an the reactor is operating at a low ASL level (between 1 and 2—see FIG. 1 ). For example, FIG. 2 shows that with an $EG/H_2O$ ratio of 4.0, the fine water sediment content is 0.14 volume % while at an $EG/H_2O$ ratio of 7.3, a 0.04 volume % fine sediment is observed.

While the present invention has been described with reference to specific embodiments, this application is intended to cover those various changes and substitutions that may be made by those skilled in the art without departing from the spirit and scope of the appended claims.

What is claimed is:

1. A process for producing an overbased phenate stearate comprising:

(a) overbasing a mixture that comprises sulfurized phenate, metal stearate, at least one solvent, calcium hydroxide, and water, by contacting said mixture with carbon dioxide in the presence of an alkyl polyhydric alcohol, while maintaining the level of agitation sufficiently high so that all solids are suspended over the length of the overbasing step, wherein the alkyl group of the alcohol has from one to five carbon atoms; and wherein the polyhydric alcohol to water ratio is maintained sufficiently high so that the ratio is at least 4:1 at the end of the overbasing step; and (b) stripping said overbased mixture to produce an overbased phenate stearate having less than 0.10 vol. % fine sediments.

2. A process according to claim 1 wherein the alkyl polyhydric alcohol is ethylene glycol.

3. A process according to claim 1 wherein the stearate is calcium stearate.

4. A process according to claim 1 wherein the sulfurized phenate comprises an overbased sulfurized phenate.

5. A process according to claim 1 wherein the polyhydric alcohol to water ratio is maintained sufficiently high so that the ratio is at least 9:1 at the end of the overbasing step.

6. A process according to claim 1 wherein the overbased phenate stearate has less than 0.05 vol. % fine sediments.

7. A process for producing an overbased phenate stearate comprising:

(a) overbasing a mixture that comprises sulfurized phenate, calcium stearate, at least one solvent, calcium hydroxide, and water, by contacting said mixture with carbon dioxide in the presence of an ethylene glycol, (1) while maintaining the level of agitation sufficiently high so that all solids are suspended over the length of the overbasing step, and (2) while maintaining the ethylene glycol to water ratio sufficiently high so that the ratio is at least 9:1 at the end of the overbasing step; and (b) stripping said overbased mixture to produce an overbased phenate stearate having less than 0.05 vol. % fine sediments.

* * * * *